US006076903A

United States Patent [19]

Vander Park

[11] Patent Number: 6,076,903

[45] Date of Patent: Jun. 20, 2000

[54] BEAM-TYPE WORK STATION IMPROVEMENTS

[75] Inventor: Antonius Adrian Vander Park, Oakville, Canada

[73] Assignee: Nova-Link Limited, Mississauga, Canada

[21] Appl. No.: 09/034,716

[22] Filed: Mar. 4, 1998

[30] Foreign Application Priority Data

Jun. 9, 1997 [CA] Canada ..... 2207344

[51] Int. Cl.[7] ..... A47B 27/00

[52] U.S. Cl. ..... 312/196; 52/36.1; 108/50.02; 312/223.3

[58] Field of Search ..... 52/36.1, 36.2, 52/36.4, 36.6; 108/50.02, 101, 97, 96, 95; 312/195, 198, 196, 107, 223.1, 223.3, 223.6, 265.6, 265.4

[56] References Cited

U.S. PATENT DOCUMENTS

| | | | |
|---|---|---|---|
| 2,981,577 | 4/1961 | Trautmann | 108/185 |
| 4,224,769 | 9/1980 | Ball et al. . | |
| 4,600,173 | 7/1986 | Frascaroli et al. . | |
| 4,619,486 | 10/1986 | Hannah et al. | 312/195 |
| 4,685,255 | 8/1987 | Kelley | 52/36.1 |
| 4,838,177 | 6/1989 | Vander Park | 312/195 |
| 4,932,177 | 6/1990 | Hinden . | |
| 5,038,539 | 8/1991 | Kelley et al. . | |
| 5,058,331 | 10/1991 | Epps | 52/36.1 |
| 5,207,041 | 5/1993 | Willis . | |
| 5,220,871 | 6/1993 | Grund et al. | 312/196 |
| 5,325,904 | 7/1994 | Leitner . | |
| 5,499,868 | 3/1996 | Schainholz . | |
| 5,852,904 | 12/1998 | Yu et al. | 52/36.4 |

FOREIGN PATENT DOCUMENTS

| | | |
|---|---|---|
| 0 006 707 | 1/1980 | European Pat. Off. . |
| 0 637 422 | 2/1995 | European Pat. Off. . |

*Primary Examiner*—Peter M. Cuomo
*Assistant Examiner*—Jerry A. Anderson
*Attorney, Agent, or Firm*—Barry R. Lipsitz

[57] ABSTRACT

A work station suitable for mounting office equipment, and particularly electrical equipment, including an elongate support beam and legs for mounting this beam in a horizontal position above a floor. Work surfaces are mounted on at least one side of this beam and a support wall is mounted on top of the beam. A support wall extension is mounted on top of this support wall so as to increase the overall height of the wall. A self-supporting equipment cabinet is connectible to one end of the support beam and has an access opening in at least one side located adjacent the end of the beam. This opening permits wiring and cable to extend from the cabinet into the beam. Support brackets with horizontal inner arm sections and steeply sloping intermediate arm sections are provided to connect work surface members to the beam.

18 Claims, 8 Drawing Sheets

BEAM-TYPE WORK STATION IMPROVEMENTS

BACKGROUND OF THE INVENTION

This invention relates to work stations suitable for mounting office and other equipment and self-supporting equipment cabinets for use with such stations.

Work stations and desks for an office environment are well known and some of these are designed for use with particular office equipment such as computers, monitors and telephones. Also, modular type furniture arrangements for an office are well known and have been in use for a number of years. With this type of furniture or work station, a number of basic available components can be used to construct a particular furniture arrangement or work station arrangement that suits the needs of the user or users.

A beam-type work station system is described in applicant's U.S. Pat. No. 4,838,177 dated Jun. 13, 1989. This system which has met with considerable commercial success is particularly suitable for mounting electrical, communication and computer equipment adjacent a horizontal work surface. Support legs mount a beam of rectangular cross-section in a horizontal position above a floor. Support brackets are detachably connected to one or both sides of the beam and rigid work surfaces are mounted on outer sections of these brackets. A housing can be provided to mount display monitors, key pads and other equipment on the beam side of the work surface.

Although the aforementioned beam-type work station has proven to be quite successful, a number of improvements to this type of work station have now been developed by the applicant. These improvements include a primary support wall that can be mounted on top of the horizontal beam in a generally vertical position and support wall extensions that can be mounted on top of the primary support wall so as to increase the overall height of the wall. Preferably, both the support wall and its extension can be used to support relatively heavy items such as shelving so as to increase the flexibility and usefulness of the work station.

It is an object of the invention to provide a novel work station system that includes a self-supporting equipment cabinet which has at least one side thereof connectible to one end of the support beam of the work station. The cabinet has at least one elevated access opening in a side thereof, which opening is adjacent an open end of the beam so that wiring and cables can extend directly from inside the cabinet to the inside of the support beam.

The work station described herein is also provided with unique support brackets that are connected to the side of the beam and that are used to mount work surface members. These brackets have horizontal inner arm sections and steeply sloping intermediate arm sections connected to the outer end of the inner arm sections. With these brackets the work surface members can be supported at a substantial height of at least 12 inches above the height of the inner arm sections. With the use of these support brackets, a major portion of electrical equipment, such as a monitor, is positioned below a horizontal plane defined by the top of the work surface member or members.

SUMMARY OF THE INVENTION

According to a first aspect of the invention, a work station suitable for mounting office and other equipment includes an elongate support beam and supporting legs for mounting this beam in a horizontal position above a floor. The primary support wall has a top edge portion with at least two openings formed therein. One or more work surface members are mountable on at least one side of the beam so as to provide a flat work surface. A primary support wall is mountable on top of the beam in a substantialty vertical position and is supported by the beam when mounted thereon. A support wall extension is mounted on top of the primary support wall so as to increase the overall height of the support wall. This wall extension is detachable from the primary support wall.

The wall extension has a rigid panel covered section comprising at least two rigid metal panel members and at least two parallel support posts extending downwardly from a bottom edge of the panel covered section.

The openings in the primary support wall receive lower sections of the support posts in order to mount the support wall extension. Bottommost edges of at least two rigid metal panel members are spaced above the top edge portion of the primary support wall in order to provide a horizontally extending gap between the primary support wall and the bottommost edges providing access for cable or wiring into hollow interiors of the primary support wall and the support wall extension.

According to another aspect of the invention, a work station system suitable for mounting and housing office and other equipment includes an elongate, hollow support beam and support members for mounting the beam in a horizontal position above a floor. One or more work surface members are mountable on at least one side of the beam and provide a flat work surface. A self-supporting equipment cabinet has one side thereof connectible to one end of the support beam. This cabinet has an end wall thereof generally aligned with one side of the beam when the cabinet is connected to the end of the beam. The cabinet has an elevated access opening in one side thereof and this opening is adjacent one end of the beam when the cabinet is connected to the one end of the support beam. The access opening permits wiring and cables to extend directly from inside the cabinet to the inside of the support beam.

In a preferred embodiment of this work station, a support wall is mounted on top of the support beam in a generally vertical position and this wall has a top that is generally the same height as a top of the cabinet.

According to a further aspect of the invention, a work station suitable for mounting office equipment includes an elongate support beam having a top with holes formed therein and supporting legs for mounting and supporting the beam in a horizontal position above a floor. There is also work surface apparatus mountable on at least one side of the beam and providing a flat work surface. A primary support wall capable of bearing loads is mountable on top of the beam in a generally vertical position so as to be supported by the beam and is detachably connected thereto. This support wall has a panel covered portion and at least two primary support posts extending downwardly from a bottom edge of the panel covered portion. At least two of the holes formed in the beam are capable of receiving the at least two primary support posts for mounting the primary support wall on the beam. A support wall extension is mounted on top of the primary support wall so as to provide a combined support wall having an overall height greater than the height of the primary support wall. The support wall extension has a panelled covered section and at least two extension support posts extending downwardly from a bottom edge of the panel cover section and into at least two openings formed in a top edge portion of the primary support wall. The panel covered section includes at least two rigid metal panel members extending over front and rear surfaces of the support extension and mounted on at least two extension support posts. At least one of the rigid panel members has a series of horizontally connecting rails integrally formed thereon and distributed over an outer surface of the at least one rigid panel member.

Further features and advantages will become apparent from the following detailed description taken in conjunction with the accompanying drawings.

DETAILED DESCRIPTION OF PREFERRED EMBODIMENTS

Figure 1:
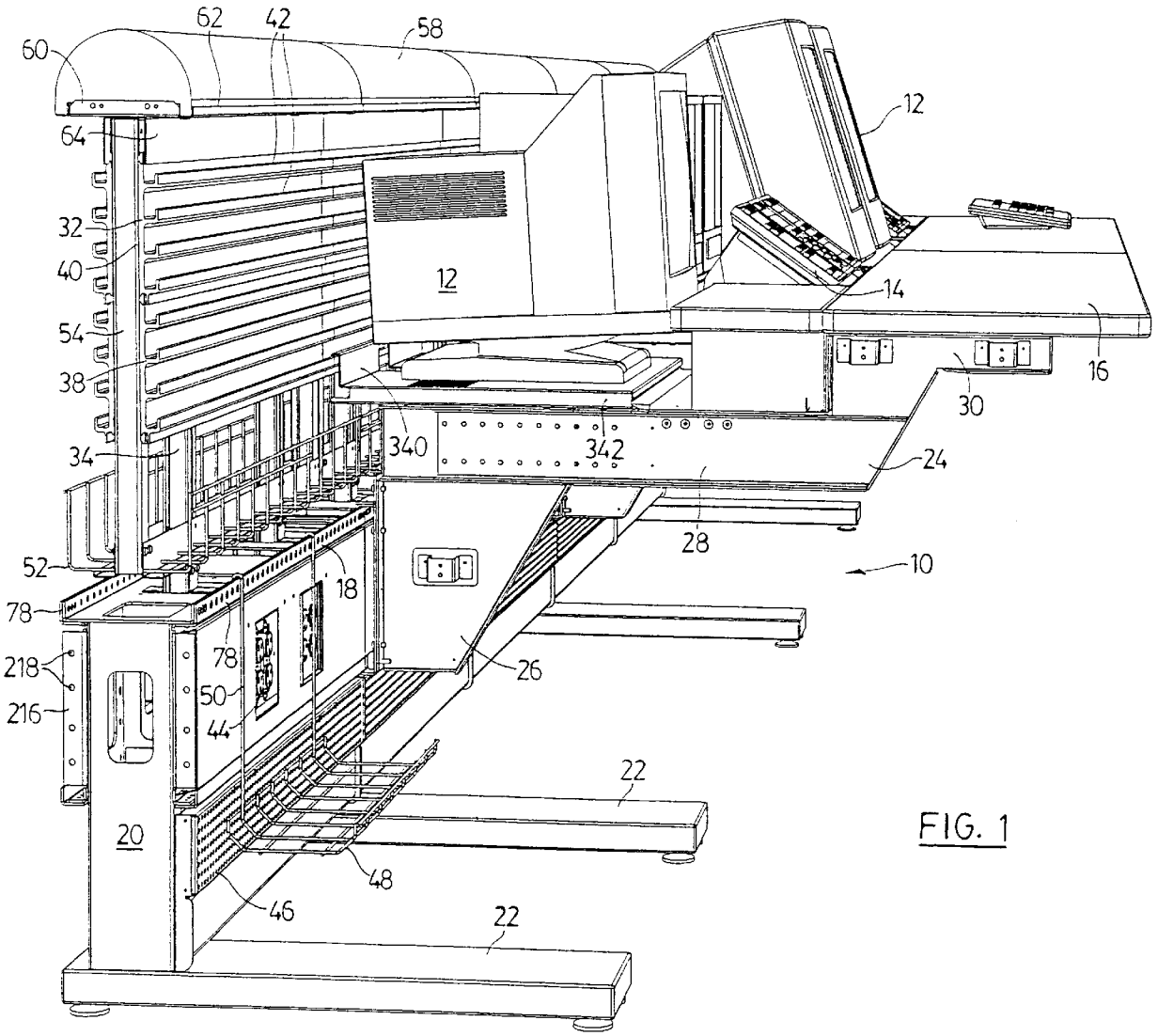
FIG. 1 is a perspective view of a beam-type work station illustrating monitors mounted thereon and other equipment, this view being taken from one end of the support beam and showing the front side of the work station.

FIG. 1 illustrates a beam-type work station constructed in accordance with applicant's co-pending British patent application No. 9611587.8 filed Jun. 4, 1996. The illustrated work station 10 is suitable for mounting television or computer monitors 12 and keypad touch equipment 14, including telephone equipment. This work station is provided with a horizontal work surface 16 which is located generally in front of the aforementioned electrical equipment. A principal component of this work station is an elongate, horizontal support beam 18 which Per se is of known construction. A beam of this type and the legs for supporting same are disclosed in applicant's U.S. Pat. No. 4,838,177. The preferred support means for mounting the beam in a horizontal position above a floor are a number of legs 20, one of which can be seen at the end of the beam 18 in FIG. 1. These legs are spaced along the length of the beam and usually would be located at each end of the beam. The legs are supported in an upright position by adjustable feet 22 that can extend in just one direction as shown in FIG. 1 or in opposite directions from their respective legs. Attached to one or both sides of the support beam are support brackets 24 with the brackets shown in FIG. 1 being of known construction. This known bracket has a downwardly extending vertical leg portion 26 which is detachably connected to the beam and an outwardly and upwardly extending arm portion 28. This arm portion can be equipped with an outer section 30 to which a work surface member is detachably connected.

Figure 2:
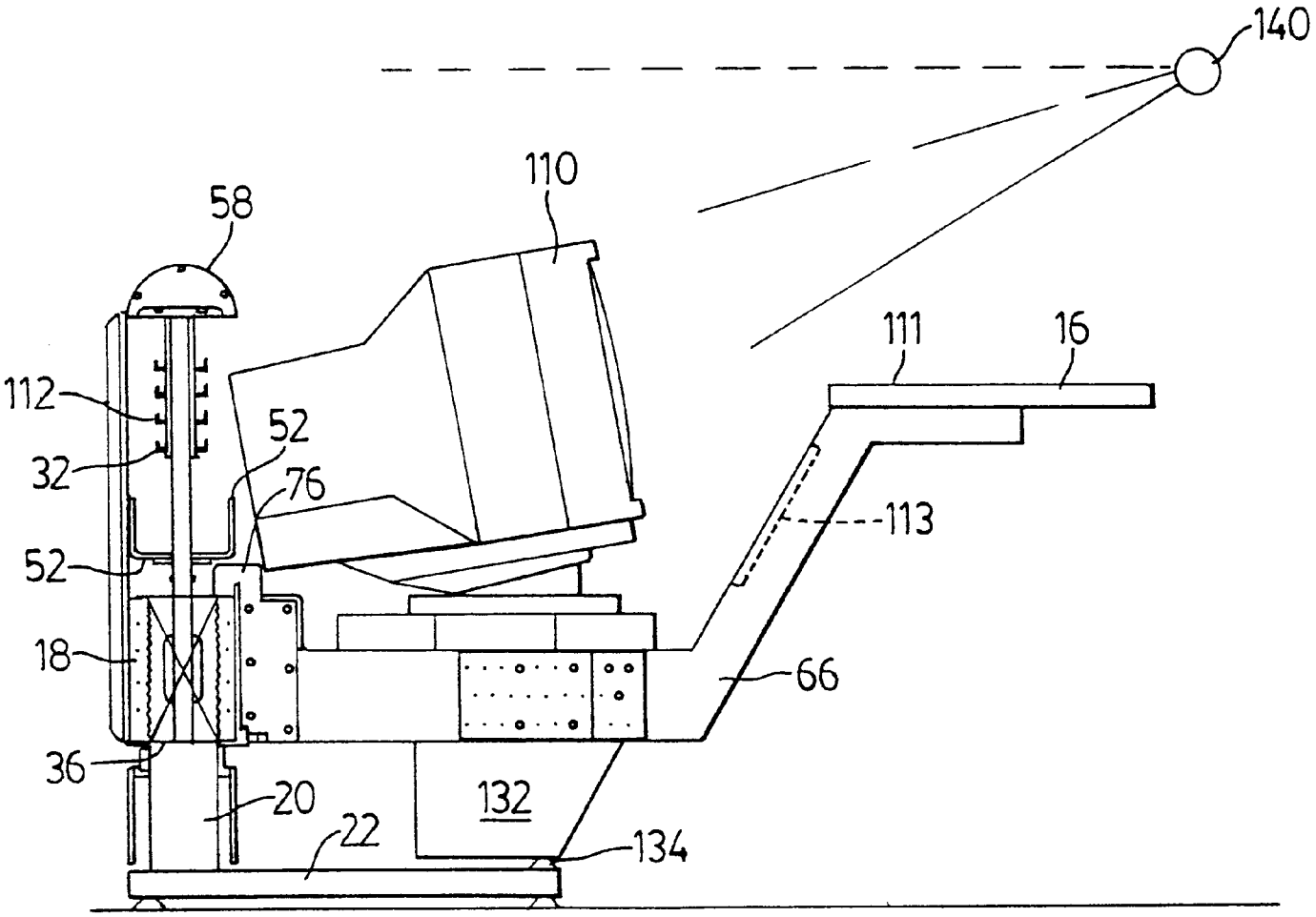
FIG. 2 is a side elevation showing the use of a new support bracket that forms a relatively deep trench behind the work surface.

In accordance with the aforementioned U.K. patent application, a primary support wall 32 is mounted on top of the support beam 18 in a generally vertical position. This wall is solely supported by the beam. Each section of this support wall is rigidly connected to the beam by means of vertical support columns or posts 34 which extend through openings formed in the top of the beam. The bottom ends of the columns 34 fit in suitable slots or openings formed in bottom plate 36 of the beam, which plate is shown in FIG. 2. Due to the rigidity of the columns 34 and the metal panels attached to the columns and the secure manner in which these columns are mounted in the beam, the support wall 32 is quite strong and rigid and can support shelving and other items of considerable weight connected thereto.

The illustrated support wall shown in FIG. 1 has a panelled covered section that includes upper and lower, rigid metal panel members 38 and 40 on both the front and the rear of the support columns. In order to reduce the weight of the support wall, these metal panel members can be made from aluminum or aluminum alloy. Each of these panel members is provided with several horizontal connecting rails 42 integrally formed thereon. These rails can extend the entire length of each section of the support wall. Each rail 42 is preferably L-shaped in cross-section with an upwardly extending leg spaced from the outer or front surface of the panel member. The bottom edge of the lower panel member 38 can be spaced some distance above the top of the support beam, thereby leaving a relatively open space between the top of the beam and the panel members for the passage of wires and cables.

Other features of the work station 10 shown in FIG. 1 include electrical outlets 44 mounted in rectangular openings in the side of the beam 18, ventilation cover plates 46 secured to the underside of the beam and made of perforated sheet metal, and wire type hanging baskets 48 that are connected by wire and hook members 50 to the top of the beam. The baskets 48 catch loose hanging or dangling cables. Also, mounted above the beam on both sides of the columns 34 are open meshed raceways 52 which can be connected by bolts to the columns 34. These raceways are also bolted to end columns 54 of the support wall 32. The raceways 52 are used to carry low voltage cable while high voltage cable which comes up through the floor and through the bottom of the beam is fed along the centre of the beam 18 and can, for example, provide power to the aforementioned outlets 44.

In the work station illustrated in FIG. 1, the top of the support wall is covered with a semi-cylindrical trim cap 58. The cap itself can be made of a variety of materials including wood, steel, aluminum and plastic. The cap is supported by a suitable metal bracket 60 and by horizontally extending lips 62, these lips being formed on outer ends of respective tie angles 64. The angles 64 are secured both to the end columns 54 and the columns 34 at the top thereof. The angles 64 have horizontal legs (not shown) that extend at right angles to the columns 34 and that support the cap 58.

Figure 5:
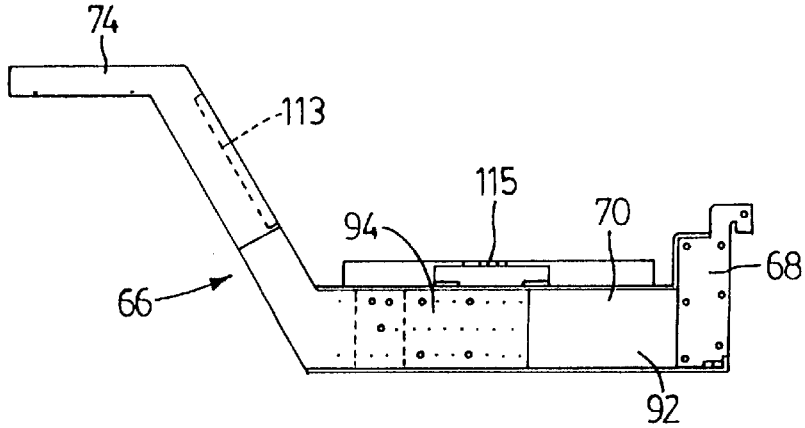
FIG. 5 is another side elevation of the new support bracket showing two supporting members attached thereto.
Figure 6:
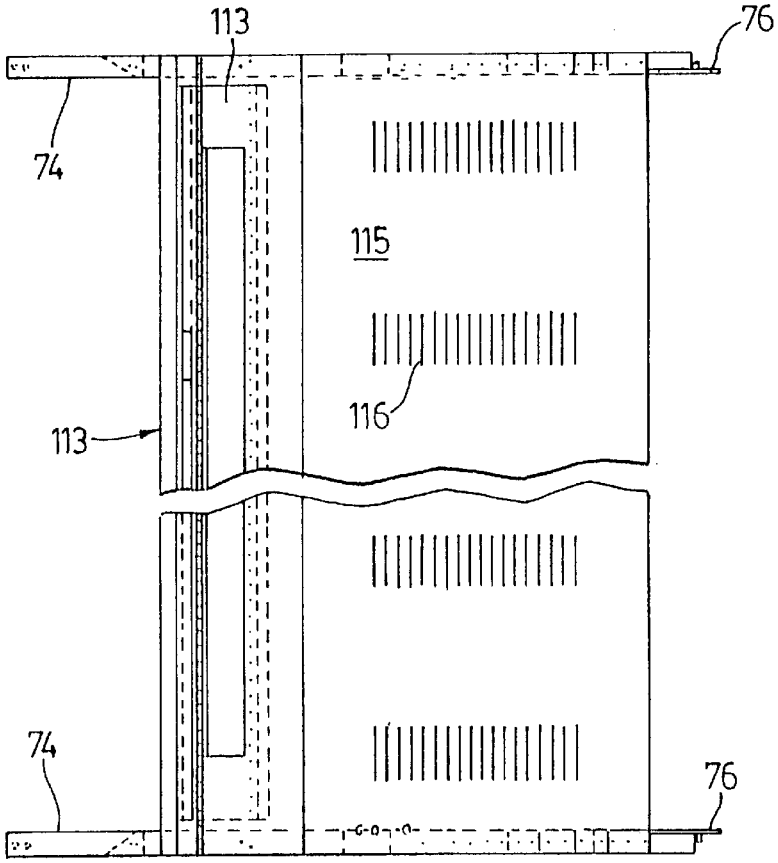
FIG. 6 is a plan view of two of the new support brackets of FIGS. 3 to 5 with supporting members extending between the two support brackets and connecting same.
Figure 7:
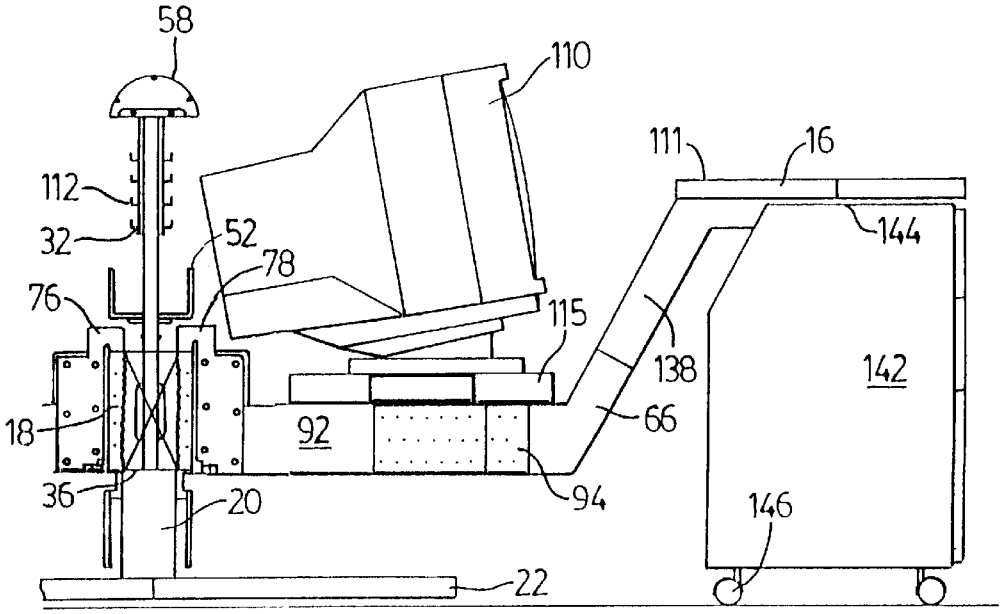
FIG. 7 is a side elevation illustrating a work station constructed in accordance with this invention and provided with a movable set of drawers.

Turning now to FIGS. 2 to 7 of the drawings, these drawings illustrate a new form of support bracket indicated generally at 66. This support bracket is also connectible to a side of the aforementioned support beam 18 as shown in FIGS. 2 and 7. Each bracket 66 includes an inner support section 68 which is connected to the support beam, a horizontal inner arm section 70 extending outwardly from the support section 68, a steeply sloping intermediate arm section 72 rigidly connected to an outer end of the inner arm section, and a horizontal outer arm section 74 rigidly connected to an outer end of the intermediate arm section. It will be particularly noted that the top of the outer arm section 74 is a substantial height of at least 12 inches above the height of the top of the inner arm section 70. This difference in height is indicated by the distance H in FIG. 3. The inner support section 68 is generally flat and comprises a vertically extending leg that extends upwardly from an inner end of said inner arm section 70. The section 68 preferably has a support hook 76 provided at the top thereof for securing the bracket to an upwardly extending flange 78 formed on the top of the beam. The support section 68 can be strengthened by forming it with a double layer or preferably triple layer of metal plate, the two or three layers being connected together by means of spot welding, preferably with at least one safety bolt, or by other suitable connectors. An adjustable, threaded stop 82 is provided at the bottom corner of this section, providing a means for levelling the support bracket. Each of the arm sections 70, 72 and 74 are provided with upper connecting flanges indicated at 84, 85 and 86 respectively. These flanges are provided with suitable holes 87 for fasteners such as bolts. There are also bottom flanges 88 to 90 formed on these arm sections. The upper and bottom flanges together provide the support bracket with increased rigidity and strength.

Figure 3:
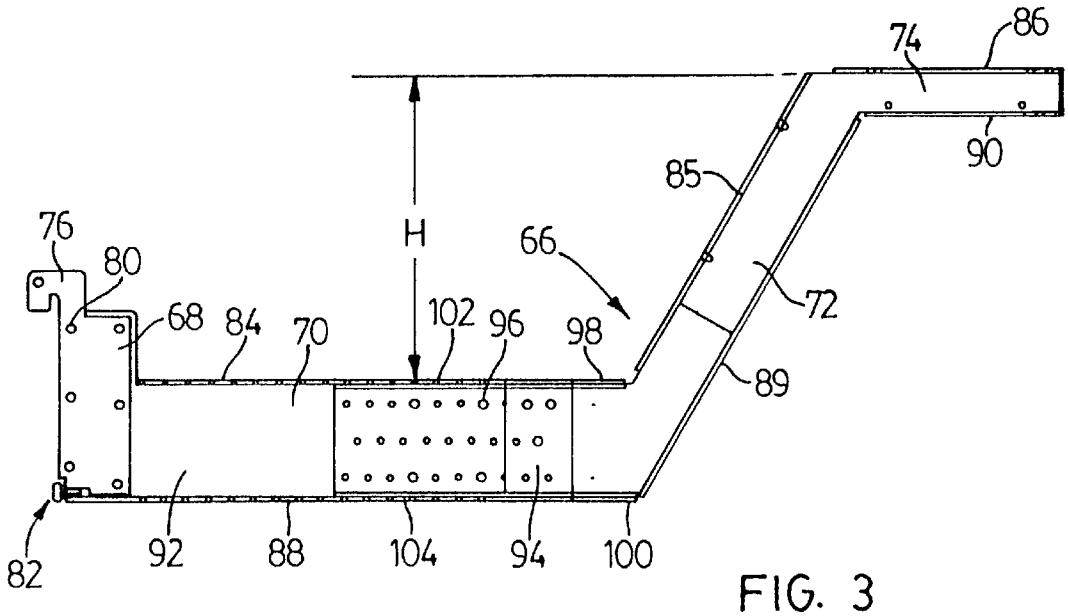
FIG. 3 is a side elevation of the new support bracket.
Figure 4:
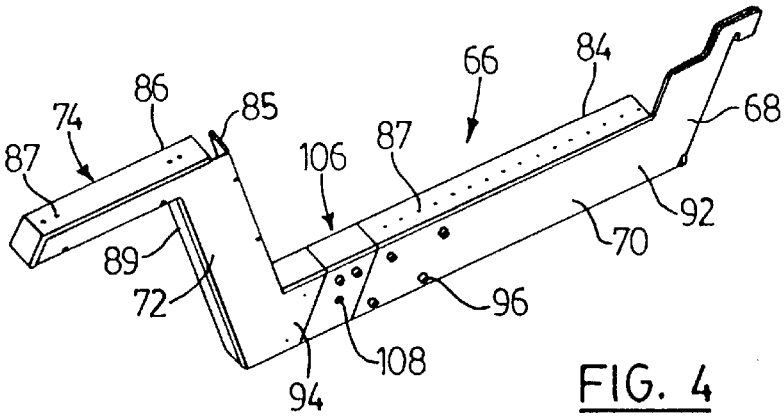
FIG. 4 is a perspective view of the new support bracket, this view being taken from above and from the front of the bracket.

Preferably the horizontal inner arm section 70 of each support bracket is extendible in order to adjust the length thereof. Thus, the inner arm section 70 includes an inner horizontal portion 92 and an outer horizontal portion 94 slidingly mounted in the inner horizontal portion in a telescoping manner. Each support bracket has threaded fasteners indicated at 96 for securing the outer horizontal portion 94 in a selected position relative to its respective inner horizontal portion 92. For example, cap screws and hex nuts can be used to secure the two portions in the desired position. Also, as shown in FIGS. 3 and 4, the upper and bottom flanges that form the inner arm sections 70 preferably form continuous outer surfaces. This is done to improve the finished appearance of the support bracket, in order to provide a continuous, smooth supporting surface for support plates and housings that can be mounted on the inner arm section and to strengthen the inner arm section. In order to provide this continuous surface, the outer horizontal portion 94 has upper and lower flange sections 98 and 100 which are aligned with connecting flanges 84 and 88 and which are relatively short. The outer portion 94 also has further upper and lower flange sections 102 and 104 which are spaced slightly inwardly relative to flange sections 98 and 100 in order to permit them to fit snugly within the flanges 84 and 88. Then, if the support bracket is arranged in an extended position as shown in FIGS. 3 and 4, a suitable, optional mid-arm extension member or trim member 106 which is channel-shaped, is attached to the outer portion 94 so as to fill the shallow gap between flange sections 98 and 100 and sections 84 and 88. This mid-arm extension, which is made of sheet metal, can be held in place by means of a single tapper screw 108. If desired, several extension members 106 of different standard lengths can be provided with each support bracket. This permits the user to choose the member 106 of the correct length depending on the amount the support bracket has been extended.

It will be understood that work surface members such as the members 16 shown in FIG. 1 can be mounted on the outer arm section 74 with these members being positioned horizontally away from and above the top of the support beam 18. As illustrated in FIGS. 5 and 6, at least one support member is provided for mounting equipment on the arm sections and, as shown in FIG. 7, relatively large electrical equipment, for example the large monitor 110, can be so positioned that a major portion thereof is below a horizontal plane defined by the top 111 of the work surface member 16. There are two support members illustrated in FIGS. 5 and 6 which are connected to one or more of the arm sections of the support brackets. These support members include an elongate front panel 113 that extends between the sloping intermediate arm sections of two brackets and bottom vented panel 115 which can be provided with ventilation slots 116. The panel 113 is provided to conceal equipment mounted on the support brackets and to protect the legs of an operator at the workstation. This panel 113 can be provided with hinged access doors, if desired. A wall power bar 128 can be mounted on the support wall behind the monitor.

In a preferred embodiment of the new support bracket 66, it has the capability of extending in the horizontal direction as much as 6 to 8 inches. This gives this support bracket considerable capability in accommodating different sizes of equipment and monitors. The use of the brackets 66 which provide a deep recess or well enables the support brackets to support large monitors (or other large equipment) as shown in FIG. 7. In a particularly preferred embodiment of the support bracket 66, the depth of the recess formed thereby, that is the height H indicated in FIG. 3, is 15 inches. If desired, left and right hand support brackets 66 (that is brackets with their connecting flanges on opposite sides) can be bolted together in a back-to-back condition to provide a combined support bracket of substantial strength. Also, a decorative trim panel 130 can be attached to the side of the support bracket and to the end of the beam by means of screws, if desired.

If desired, or if required by the substantial weight being carried by the support brackets, an additional supporting member 132 for one or more of the support brackets 66 can be provided (see FIG. 2). The supporting member 132, which is made of sheet metal, is connected to a bottom of the inner arm section 70 of its respective support bracket by means of bolts (not shown) and extends downwardly to a support surface such as the top of foot 22. The total height of the supporting member 132 can be adjusted by means of a threaded height adjuster 134. A suitable threaded hole is provided in the bottom of the member 132 for this purpose.

The aforementioned large monitor 110, for example a 21 inch monitor, is supported on the horizontal panel 115. Because of the relatively low height of the monitor 110, the 21 inch screen of the monitor can readily be viewed from the normal eye position indicated at 140 in FIG. 2. Even using the large monitor 110, with the deep well support brackets 66 of the invention the top of the monitor is below 36 inches from the floor (the normal minimum height of the support wall 32). Also, in this position, the monitor 110 does not interfere with the view of a higher monitor that may be mounted above it on the support wall.

If desired, a movable set of desk drawers 142 can be placed under one or more of the work surface members 16 and between the support brackets 66. The top 144 of these drawers is slightly lower than the bottom of the members 16. The drawers can be mounted on four pivoting rollers 146.

Figure 8:
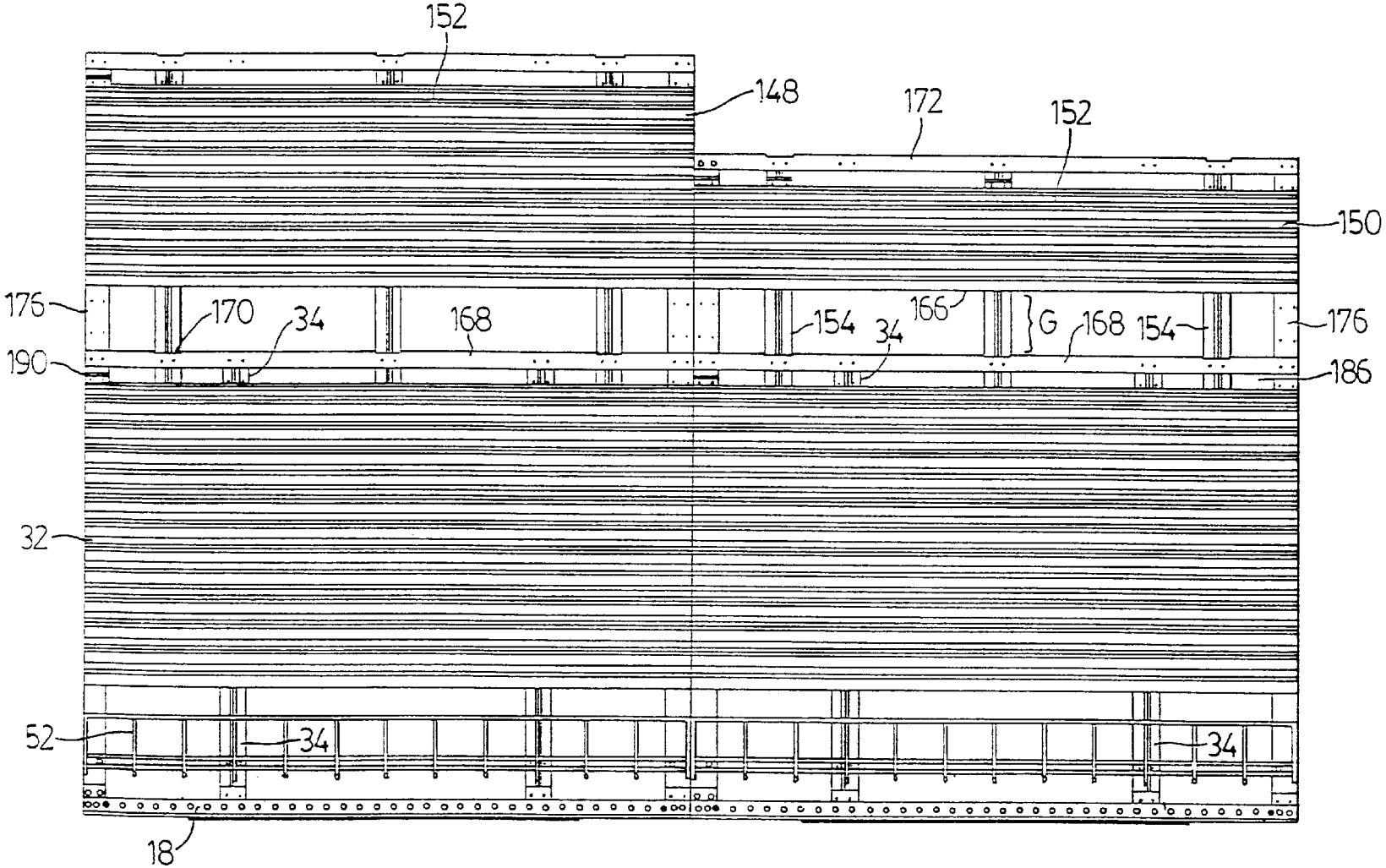
FIG. 8 is a front view of a support wall mounted on top of a horizontal beam, this wall being provided with two support wall extensions of different heights.
Figure 9:
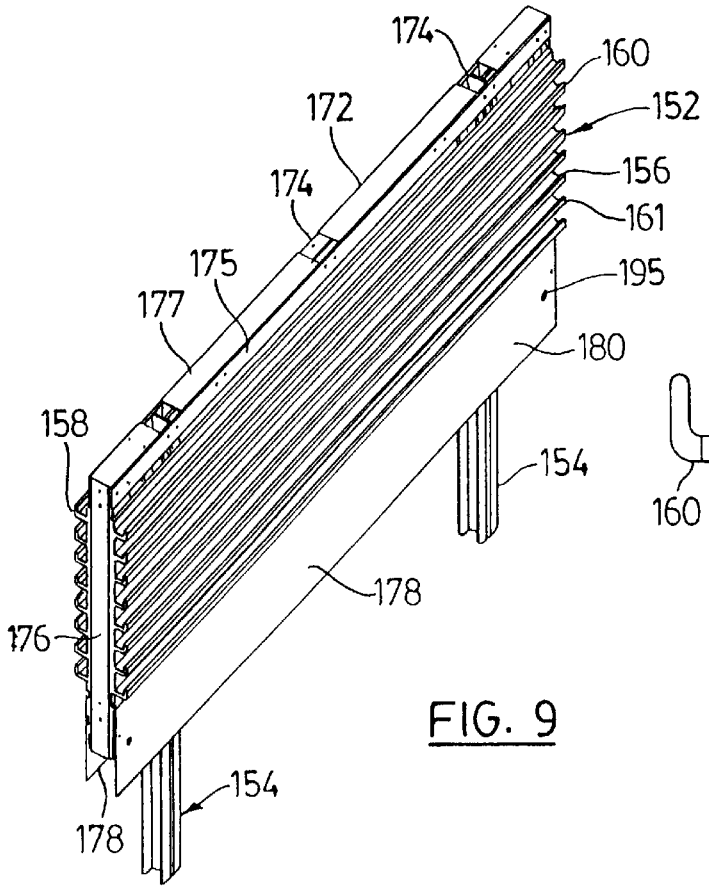
FIG. 9 is a perspective view of a support wall extension taken from above and showing one end of the extension.

Turning to FIG. 8 of the drawings, there is shown a primary support wall 32 made up of two adjacent support wall sections rigidly mounted on the top of beam 18 (only the top of which is shown). Two support wall extensions 148 and 150 of different heights are mounted on top of the support wall 32 so as to increase the overall height of the support wall. Each support wall extension is detachably mounted to the primary support wall below it. Each support wall extension has a rigid panel covered section 152 and at least two parallel support posts 154 extending downwardly from a bottom edge of the panel covered section. In the support wall extensions shown in FIG. 8, each extension has three of these support posts. In the embodiment of FIG. 9, to which reference will now be made, the wall extension has only two posts 154. Like the posts 34 of the primary wall, the posts 154 are preferably made of two, elongate channel members placed back-to-back and connected together along their lengths by means of spot welds or suitable fasteners. In the illustrated preferred embodiment, the panel covered section includes at least two rigid metal panel members 156, 158 extending over front and rear surfaces of the support wall extension and mounted on the support posts. At least one of these panel members can have horizontal connecting rails 160 integrally formed thereon. These rails can be similar in their size and construction as the aforementioned rails formed on the primary support wall 32. Preferably, the panel members 156, 158 are made of aluminum or aluminum alloy and the rails 160 have a L-shaped cross-section with an upwardly extending leg 161 shown in greater detail in FIG. 10. These rails help to increase the rigidity of the panel members. The leg 161 is spaced from an outer surface 162 of its respective panel member. Downwardly extending from the bottommost rails 160 is a short, integral cover section 164 which covers fastening members as explained hereinafter.

Figure 10:
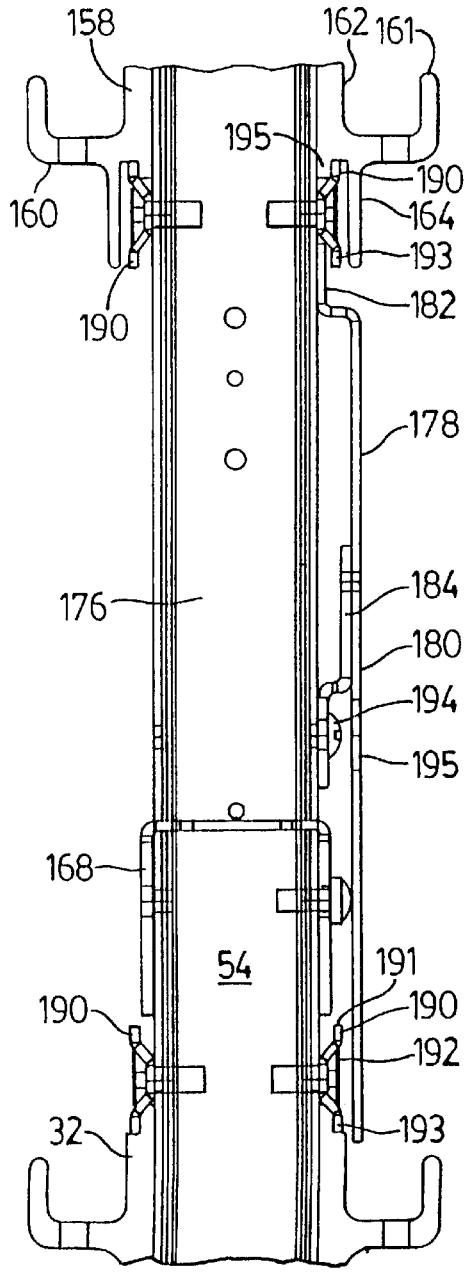
FIG. 10 is a detailed edge view showing the construction of a trim panel extending along a lower portion of a support wall extension constructed as shown in FIG. 9.

As shown in FIGS. 8 and 10, bottom edges 166 of the metal panel members are spaced above the top of the primary support wall, this top being formed by a channel member 168. The channel is connected to the top of the columns 34 and is rigidly supported thereby. Rectangular openings 170 are formed at the required locations along the channel 168 to receive the posts 154. In this way, bottom sections of these posts 154 can slide into the hollow interior of support wall 32. However, the distance that the posts 154 can slide into the support wall is limited by end columns 176 on each wall extension, the bottoms of which engage the channel member 168 in order to leave the gap G between the bottom edges of the metal panel members and the top of the primary support wall 32. This gap provides access for cable or wiring or for repairs into the hollow interiors of both the support wall 32 and panel covered sections 152. In a preferred embodiment, the gap G is 6 inches high. Another reason for this gap is to maintain consistency in this work station system. Note that in this preferred embodiment, the individual wall panel sections are also 6 inches in height consisting of four rails spaced 1½ inches apart.

Additional components of each support wall extension 148, 150 include a top inverted U-shaped channel member 172 which is connected to the top of the posts 154. The sheet metal member 172 has two downwardly extending sides 175 and a connecting web portion 177 extending between these sides. The web portion can be provided with two or more spaced apart access holes 174 therein. If desired, these holes can be used to permit cables or wires to extend into and out of the support wall extension through the top edge thereof. Holes can also be provided along the channel member 172 for connecting a trim cap such as the trim cap 58 shown in FIG. 1. This trim cap can be supported in the same manner that it is supported when mounted on the top of the primary support wall. Incidentally, it is of course necessary to remove any trim cap 58 that has been mounted on the primary support wall 32 (together with its supporting bracket and angle members) before mounting a support wall extension 148, 150 to the support wall 32.

Each end of the support wall extension is closed by means of the end column 176 which is made of sheet metal. The sides 175 of channel member 172 are connected to the upper end of these end columns.

Two detachable trim panels 178, which are made of sheet metal, preferably extend over front and rear surfaces of the support wall extension and form a lower portion of the aforementioned panel covered section 152. These trim panels have a generally flat outer surface 180 and can be made of a thinner metal than the aluminum panel members that form the rest of this panel covered section. Each trim panel has a L-shaped flange 182 extending along an upper edge thereof and projecting inwardly from the panel's outer surface and also has metal connecting members 184 mounted on an inner surface thereof and located about midway between the top and bottom edges of the panel. The members 184 also act as spacers, thus maintaining the outer surface 180 parallel to the metal panel members above and below the trim panel. Each connecting member 184 can be connected to an adjacent end column 176 (and also to an adjacent post 154, if desired). The trim panel should extend downwardly sufficiently to cover both the channel 168 and an opening 186 that may be provided or formed below the channel 168.

The metal panels of the support wall 32 can be connected at the top to end columns 54 by means of short metal clips 190 shown in FIGS. 8 and 10. These clips can be provided with two side-by-side openings to receive two screws 192. Each clip 190 has upper and lower edge flanges 191, 193 that are spaced from the adjacent side of the column. The upper flange 191 extends over a short downwardly extending flange 195 formed along the bottom of the panel section. By attaching the clip with two screws 192, the clip is always correctly aligned with the panel edge. As shown in FIG. 10, the bottom edge of the trim panel covers the clips 190 and their screws, providing a neat, clean appearance. The top edge of the trim panel fits under the lower section of the clips 190 that secure the metal panels 158 and 162 at their bottom edges. These clips 190 are covered by the aforementioned cover sections 164. The screws 194 that are used to attach the trim panels by means of the connecting members 184 are inserted through suitable holes 195 formed in the trim panel at each end. These screws extend through a hole in the member 184 and into the end column 176.

In order to attach the panel members 156, 158, the bottom clips 190 are attached first to their end columns 176 and posts 154. The panel member 156 or 158 is then set in its place in engagement with the clips as shown. Then the top clips 190 are secured to their end columns and posts in order to hold the upper edge of the panel member. Then the next panel member above the installed panel member is put into place and the procedure continues. Because each wall extension is hollow, the user is able to pass cables and wires through these wall extensions, if required. Additional levels of cable buses can be arranged along and supported by the support wall extensions, if desired. These can be similar to the raceways 52 shown in FIG. 1. Suitable shelving can also be mounted, of course, on the support wall extensions using the horizontal rails 160. It will be appreciated that the support wall extensions allow a modular expansion of the primary support wall 32 where required to increase the amount of equipment supported. Moreover, this can be carried out as a retrofit without disturbing the initial installation.

Turning now to FIGS. 11 to 14 of the drawings, these drawings illustrate the use of a self-supporting equipment cabinet 200 which can be used in combination with the above described work station and which can house electrical or other equipment required in conjunction with or near the work station. The cabinet 200 has at least one side thereof connectible to one end of the support beam 18 which can be seen in FIGS. 11 and 12. The cabinet has an end wall 202 which is generally aligned with and parallel to one vertical side of the beam indicated at 204 when the cabinet is connected to the aforementioned one end of the beam. In the embodiment illustrated in FIG. 12, both vertical sides 205 and 206 of the cabinet are connected to adjacent ends of support beams 18 that extend outwardly from these sides. Thus, in this version there are work stations on both sides of the cabinet. One preferred form of cabinet 200 is a so called rack mount cabinet for holding electrical equipment such as universal rack mount equipment. In the embodiment shown in FIG. 12 (which does not show any support brackets or working surfaces for easy of illustration), a support wall 32 is mounted on top of the support beam 18 in a generally vertical position. The illustrated wall does not have any support wall extensions. It could be provided with one or more extensions, if required. The support wall has a top indicated generally at 208 which is generally at the same height as the top 210 of the cabinet. This provides a pleasing and unified appearance for the combination of the work stations and cabinet. This unified appearance is enhanced by the use of the decorative, elongate wall trim 58 that is mounted along the top of the support wall and that also extends across the top of the cabinet as shown. This wall trim has a selected cross-sectional profile which is uniform along its length. As shown, the trim has a semi-cylindrical shape but it could also have a flat top with sloping side edges, for example. It will be understood that means are provided for mounting a similar trim member 59 made of wood, metal or plastic and having the same cross-sectional profile as the trim 58 on top of the cabinet 200 so that trim member 59 is aligned with the elongate wall trim 58 both vertically and horizontally. For example, the trim member 59 can be mounted on the top of the cabinet by means of a horizontal metal base plate extending the length thereof, which base plate (not shown) can be attached by means of screws or bolts to the top of the cabinet.

Figure 11:
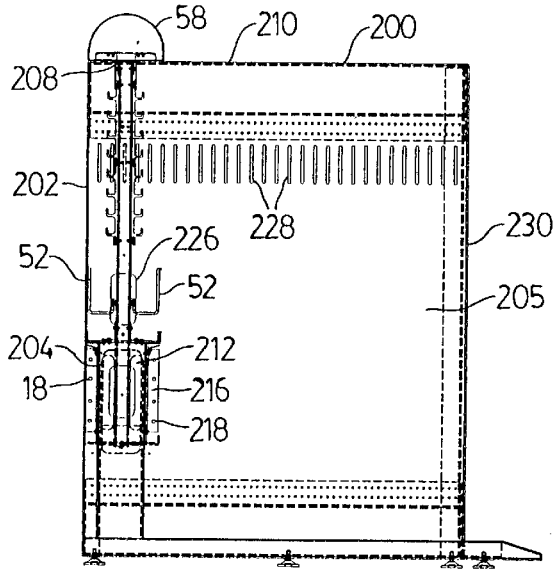
FIG. 11 is a side elevation illustrating the combination of a self-supporting cabinet and a hollow support beam for a work station, the beam being provided with a support wall extending upwardly from the top of the beam.
Figure 12:
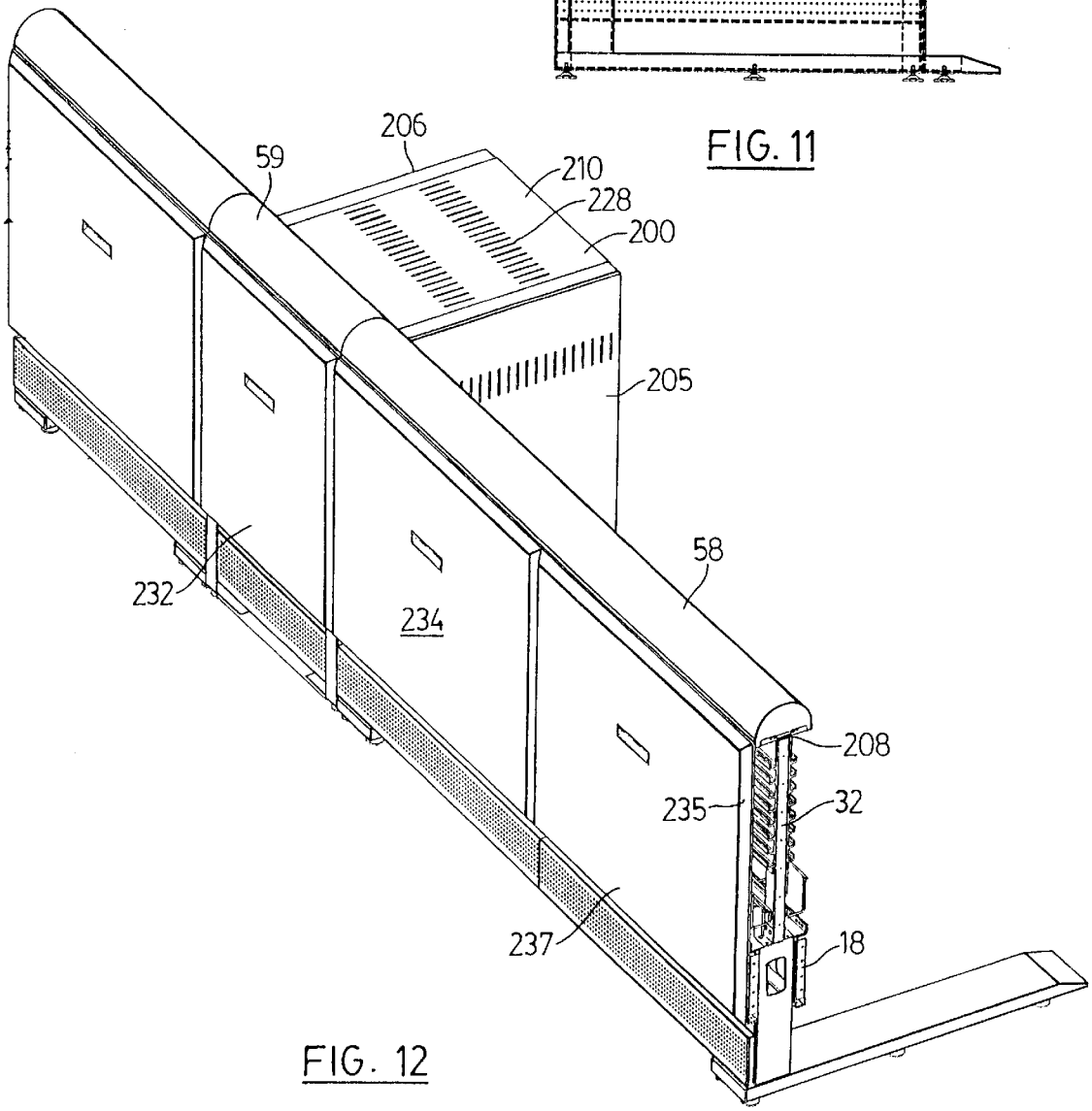
FIG. 12 is a perspective view taken from above showing the aforementioned self-supporting cabinet with support beams and support walls extending from opposite sides thereof.
Figure 13:
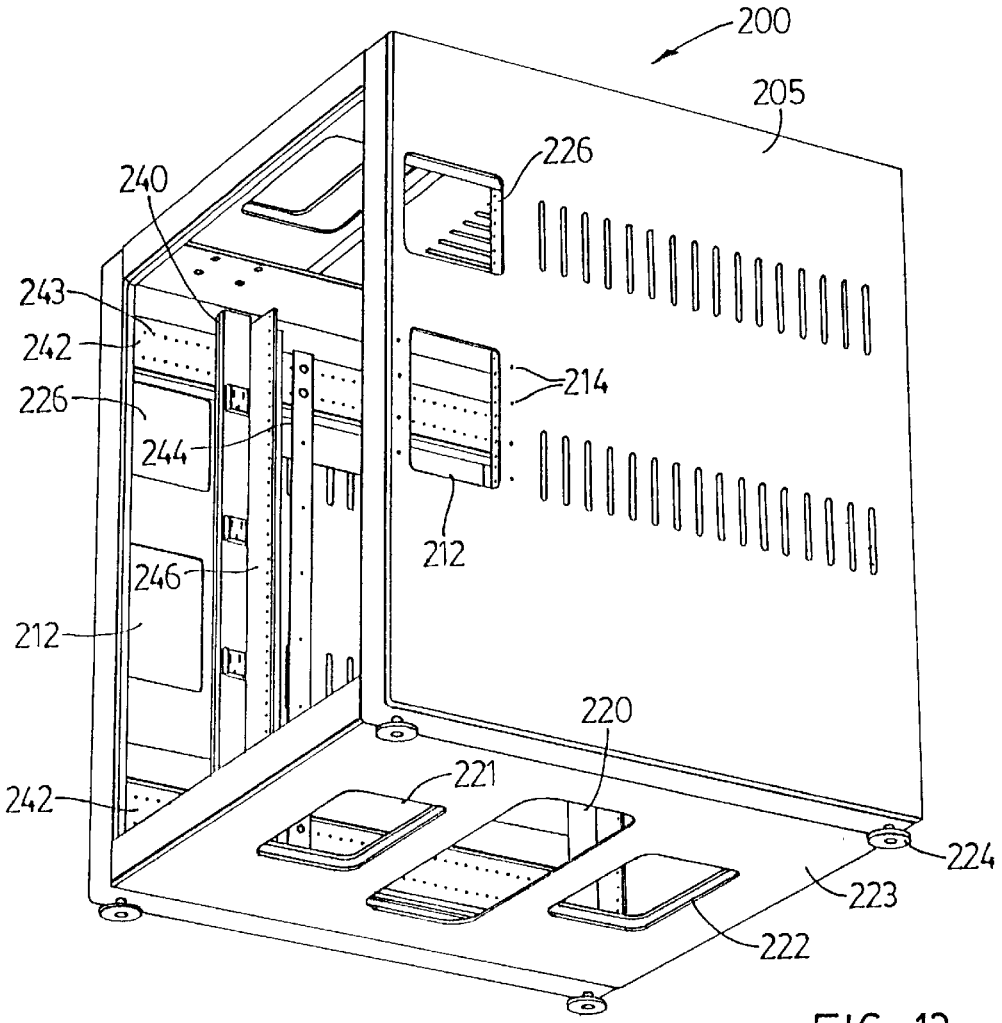
FIG. 13 is a perspective view of a preferred embodiment of the self-supporting cabinet, this view being taken from below and showing the rear of the cabinetin an open condition.

Turning to FIG. 13 of the drawings, the cabinet 200 has an elevated access opening 212 on each of its vertical sides 205, 206 and when the cabinet is arranged in the manner shown in FIGS. 11 and 12, this opening is adjacent one end of the beam 18. The cabinet can be connected to this end of the beam using suitable bolts or screws, holes 214 formed in the side of the cabinet, and connecting flanges 216 provided at the end of the beam. The flanges are also provided with bolt or screw holes 218. Access openings 212 permit wiring and cables to extend directly from inside the cabinet to the inside of the support beam 18. The cabinet can also be provided with relatively large openings 220 to 222 formed in a bottom wall 223 thereof. These openings are also provided to permit cables and wires to extend through the bottom wall of the cabinet, for example, from floor openings. The bottom of the cabinet has adjustable feet 224 mounted thereon which feet are per se of known construction. They permit the cabinet to be raised or lowered to some extent and to be levelled. Preferably, a second elevated access opening 226 is provided in each side 205 and 206, this opening being spaced above the access opening 212. As shown in FIG. 11, the two elongate, horizontal cable buses or raceways 52 mounted on the support wall 32 have their ends aligned with this opening 226 so that low voltage wiring and cables can extend from these raceways into the cabinet and vis-versa. The cabinet is preferably made 6 inches longer than required by the equipment to be mounted therein in order to provide room for the system service's route through the cabinet. Cabinet ventilation openings 228 can be provided in the upper region of each side 205, 206 of the cabinet and also in the top of the cabinet.

The cabinet 200 includes front and rear removable end walls 230, 202, the aforementioned side walls 205, 206 and the top wall 210. All of these walls and the bottom wall can be made of sheet metal. The side walls 205, 206 are constructed so that they are sufficiently strong and rigid to be load bearing. If desired, one or both end walls 230, 231 can be covered with a decorative panel 232 shown in FIG. 12. This panel can be similar in its design and construction as other decorative panels 234 used to cover the back of beam 18 and support wall 32. The panels 232, 234 can be constructed of wood, preferably with steel edges 235 and a fabric finish 237. The panels 232 and 234 can be attached in any suitable manner to the cabinet and to the beam and support wall respectively, for example, by means of metal clips (not shown). These panels can also be made simply of metal or wood covered with a wood veneer or high pressure plastic laminate.

Figure 14:
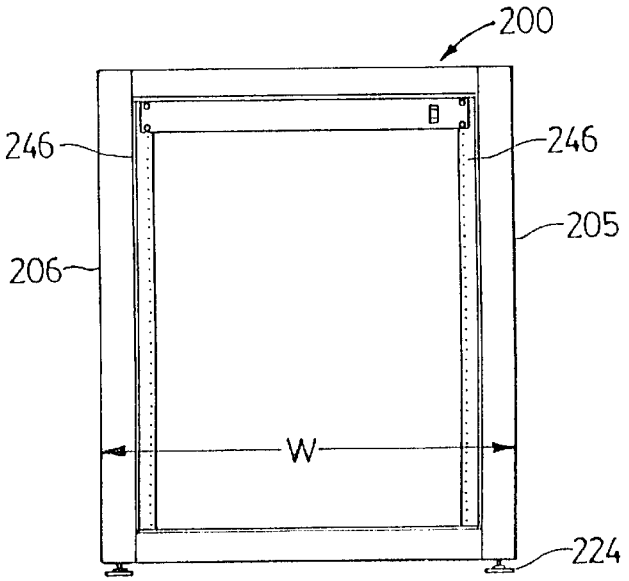
FIG. 14 is a front view of the cabinet of FIG. 13.

The width of a standard cabinet 200 is indicated by W in FIG. 14. In one preferred embodiment of the cabinet, this width is 24 inches and the height of the cabinet is 29 inches. It will be appreciated that the support beam 18 is constructed of a number of standard length beam sections that are detachably connected together by means of bolts in an end-to-end manner. The general construction of each beam section is detailed in applicant's issued U.S. Pat. No. 4,838,177. Preferably, the cabinet 200 has a width W in a direction perpendicular to the sides 205, 206 which is equal to a standard length of a beam section or a multiple thereof. Thus, a standard length of a beam section can be 24 inches, the same as the width of the preferred cabinet illustrated in FIGS. 13 and 14. In this way, it is a fairly simple matter to replace an existing beam section with one of the equipment cabinets 200 or vis-versa without disturbing the position of adjacent sections of the beam or adjacent work stations.

Other optional preferred features of the illustrated rack cabinet shown in FIG. 13 include a vertical plug mold mounting 240 that can be attached at the top and bottom to horizontal brace members 242. The brace members which run from the front to the rear of the cabinet are provided with two rows of mounting holes 243 which preferably run along a line having a ½ inch pitch from the front to the rear of the cabinet. Also shown is a bus bar 244 which is made of aluminum and provides grounding capability for the equipment. Vertical support frames 246 on both sides of the cabinet can be attached by means of a suitable connecting flange to the horizontal braces 242.

It will be appreciated from the above description that a number of improvements to applicant's original beam-type work station system as described in its U.S. Pat. No. 4,838,177 have been provided. The resulting improved work station has additional flexibility and usefulness and can fit a wide variety of electrical and communication equipment. The height of the central support wall, on which shelving can be mounted, can be increased as required. However, the described furniture system is still able to create a low profile, if desired, while maintaining the ability to accommodate a wide variety of equipment.

It will be readily apparent to those skilled in this art that various modifications and changes can be made to the described, improved work station, extendible support wall, support brackets, and other described features without departing from the spirit and scope of this invention. Accordingly, all such modifications and changes as fall within the scope of the appended claims are intended to be part of this invention.

I claim:

1. A work station suitable for mounting office equipment comprising:

an elongate support beam;

supporting legs for mounting said beam in a horizontal position above a floor;

work surface apparatus mountable on at least one side of said beam and including a flat work surface member;

a primary support wall capable of bearing loads and mountable on top of said beam in a substantially vertical position so as to be supported by said beam, said primary support wall having a top edge portion with at least two openings formed therein; and a support wall extension mounted on top of said primary support wall so as to provide a combined support wall having an overall height greater than the height of the primary support wall, said support wall extension being detachable from said primary support wall and having a rigid panel covered section comprising at least two rigid metal panel members forming front and rear surfaces of said support wall extension and at least two parallel support posts extending downwardly from a bottom edge of said panel covered section, said at least two metal panel members being mounted on said at least two support posts, wherein said openings in said primary support wall receive lower sections of said at least two support posts in order to mount and rigidly support said support wall extension on said primary support wall and wherein bottommost edges of said at least two rigid metal panel members are spaced above said top edge portion of said primary support wall in order to provide a horizontally extending gap between said primary support wall and said bottommost edges providing access for cable or wiring into hollow interiors of the primary support wall and said support wall extension.

2. A work station according to claim 1 including two, detachable trim panels extending over a front and a rear of said support wall extension and detachably mounted to said support wall extension below said at least two, rigid metal panel members, said trim panels having a generally flat outer surface and being made of a thinner metal than said rigid metal panel members.

3. A work station according to claim 2 wherein each trim panel has an L-shaped flange extending along an upper edge of the trim panel and projecting inwardly from the trim panel's outer surface and further has connecting members mounted on an inner surface of the trim panel.

4. A work station according to claim 1 wherein a top edge of said support wall extension is formed with an inverted U-shaped channel member with two downwardly extending sides and a web portion connecting these two sides, said web portion having two or more, spaced-apart holes formed therein.

5. A work station suitable for mounting office equipment comprising:

an elongate support beam having a top with holes formed therein;

supporting legs for mounting and supporting said beam in a horizontal position above a floor;

work surface apparatus mountable on at least one side of said beam and providing a flat work surface;

a primary support wall capable of bearing loads and mountable on top of said beam in a generally vertical position so as to be supported by said beam and detachably connected thereto; said support wall having a panel covered and at least two primary support posts extending downwardly from a bottom edge of said panel covered portion, at least two of said holes formed in the beam being capable of receiving said at least two primary support posts for mounting said primary support wall on said beam; and a support wall extension mounted on top of said primary support wall so as to provide a combined support wall having an overall height greater than the height of the primary support wall, said support wall extension having a panel covered section and at least two extension support posts extending downwardly from a bottom edge of said panel covered section and into at least two openings formed in a top edge portion of said primary support wall, said panel covered section including at least two rigid metal panel members extending over front and rear surfaces of said support extension and mounted on said at least two extension support posts, wherein at least one of said rigid panel members has a series of horizontal connecting rails integrally formed thereon and distributed over an outer surface of the at least one rigid panel member.

6. A work station according to claim 5 wherein said panel covered section of the support wall extension is substantially hollow to permit easy passage of wires and cables therethrough.

7. A work station according to claim 5 wherein said at least two rigid metal panel members are made of aluminum or aluminum alloy and said connecting rails each have an L-shaped cross-section with an upwardly extending leg spaced from said outer surface of the at least one rigid panel member.

8. A work station according to claim 5 wherein said at least two rigid metal panel members are made of aluminum or aluminum alloy, said connecting rails each have an L-shaped cross-section, and said connecting rails extend the length of their respective metal panel members.

9. A work station according to claim 8 wherein said extension support posts each comprise two, elongate channel members placed back-to-back and rigidly connected together.

10. A work station according to claim 5 wherein said at least two primary support posts are spaced inwardly from vertically extending ends of said panel covered portion.

11. A work station according to claim 5 wherein bottommost edges of said at least two rigid metal panel members are spaced above said top edge portion of said primary support wall in order to provide a horizontally extending gap providing access for cable or wiring into a hollow interior of sad support wall extension.

12. A work station according to claim 11 wherein said support wall extension includes two vertical end columns located at said opposite ends of the support wall extension and bottom ends of said end columns engage and are supported on said top edge portion of the primary support wall.

13. A work station suitable for mounting office equipment comprising:

an elongate support beam;

supporting legs for mounting said beam in a horizontal position above a floor;

work surface apparatus mountable on at least one side of said beam and including a flat work surface member;

a hollow primary support wall capable of bearing loads, mountable on top of said beam in a substantially vertical position, and having two opposite ends that extend vertically, said primary support wall having a top edge portion with at least two openings formed therein, said at least two openings being spaced inwardly from said opposite ends, said support wall further including rigid metal panel members forming front and rear surfaces of the support wall;

a support wall extension mountable on said top edge portion of said primary support wall and providing thereby a combined support wall having an overall height greater than the height of the primary support wall, said support wall extension being detachable from said primary support wall and having a rigid panel covered section comprising at least two further rigid metal panel members forming front and rear surfaces of said support wall extension, and at least two parallel support posts extending downwardly from and connected to said further rigid metal panel members, said support posts being spaced inwardly from opposite ends of the support wall extension, wherein, during use of said support wall extension, said at least two support posts extend through said at least two openings in said top edge portion and are supported along front and rear sides of said support posts by said metal panel members of said primary support wall.

14. A work station according to claim 13 wherein said support wall extension includes two vertical end columns located at said opposite ends of the support wall extension and, during use of said support wall extension, bottom ends of said end columns engage and are supported on said top edge portion of the primary support wall.

15. A work station according to claim 14 wherein, when said support wall extension is mounted on said primary support wall, bottommost edges of said at least two further rigid metal panel members are spaced above said top edge portion of said primary support wall in order to provide a horizontally extending gap between said primary support wall and said bottommost edges.

16. A work station according to claim 15 wherein at least one of said further rigid metal panel members of said support wall extension has horizontal connecting rails integrally formed thereon.

17. A work station according to claim 16 including two, detachable trim panels extending over a front and a rear of said support wall extension, said two trim panels having a generally flat outer surface and being made of a thinner material than said rigid metal panel members of the support wall extension.

18. A work station according to claim 16 wherein said at least two rigid metal panel members are made of aluminum or aluminum alloy and said connecting rails each have an L-shaped cross-section with an upwardly extending leg spaced from an outer surface of the respective panel member.

* * * * *